US008988291B2

(12) United States Patent
Qi et al.

(10) Patent No.: US 8,988,291 B2
(45) **Date of Patent: *Mar. 24, 2015**

(54) MOBILE WIRELESS COMMUNICATIONS DEVICE COMPRISING A SATELLITE POSITIONING SYSTEM ANTENNA WITH ACTIVE AND PASSIVE ELEMENTS AND RELATED METHODS

(75) Inventors: Yihong Qi, St. Agatha (CA); Adrian Cooke, Kitchener (CA); Ying Tong Man, Waterloo (CA); Perry Jarmuszewski, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 105 days.

This patent is subject to a terminal disclaimer.

(21) Appl. No.: 13/300,823

(22) Filed: Nov. 21, 2011

(65) Prior Publication Data

US 2012/0064943 A1 Mar. 15, 2012

Related U.S. Application Data

(63) Continuation of application No. 12/638,093, filed on Dec. 15, 2009, now Pat. No. 8,063,836, which is a continuation of application No. 11/288,896, filed on Nov. 29, 2005, now Pat. No. 7,656,353.

(51) Int. Cl.

| | |
|---|---|
| ***H01Q 1/24*** | (2006.01) |
| ***H01Q 1/38*** | (2006.01) |
| ***H01Q 9/42*** | (2006.01) |
| ***H01Q 19/00*** | (2006.01) |
| ***H01Q 21/29*** | (2006.01) |

(52) U.S. Cl.

CPC ..... *H01Q 1/243* (2013.01); *H01Q 1/38* (2013.01); *H01Q 9/42* (2013.01); *H01Q 19/00* (2013.01); *H01Q 21/29* (2013.01)

USPC ..... 343/702; 343/833

(58) Field of Classification Search

CPC ..... H01Q 1/243; H01Q 9/42; H01Q 9/0421; H01Q 9/0442; H01Q 19/00; H01Q 21/29

USPC ..... 343/702, 825, 828, 833, 834, 841; 455/575.7

See application file for complete search history.

(56) References Cited

U.S. PATENT DOCUMENTS 4,223,317 A * 9/1980 Rod ..... 343/803
5,161,255 A * 11/1992 Tsuchiya ..... 455/345

(Continued)

FOREIGN PATENT DOCUMENTS

| | | | |
|---|---|---|---|
| WO | 01/59938 | 8/2001 | ..... H04B 1/00 |
| WO | 02/29988 | 4/2002 | ..... H04B 1/38 |
| WO | 03/063291 | 7/2003 | |

*Primary Examiner* — Michael C Wimer

(74) *Attorney, Agent, or Firm* — Allen, Dyer, Doppelt, Milbrath & Gilchrist, P.A.

(57) ABSTRACT

A mobile wireless communications device may include a portable housing, at least one wireless transceiver carried by the portable housing, and a satellite positioning signal receiver carried by the portable housing. Moreover, a satellite positioning antenna may be carried by the portable housing. The satellite positioning antenna may include an active element connected to the satellite positioning signal receiver, and a passive element connected to a voltage reference and positioned in spaced apart relation from the active element and operatively coupled thereto for directing a beam pattern thereof.

18 Claims, 11 Drawing Sheets

(56) References Cited

U.S. PATENT DOCUMENTS

| | | | | |
|---|---|---|---|---|
| 5,220,335 | A | 6/1993 | Huang | 343/700 MS |
| 5,507,012 | A | 4/1996 | Luxon et al. | 455/575.5 |
| 5,627,550 | A * | 5/1997 | Sanad | 343/700 MS |
| 5,884,199 | A * | 3/1999 | Maki | 455/575.1 |
| 6,034,638 | A * | 3/2000 | Thiel et al. | 343/702 |
| 6,492,952 | B1 | 12/2002 | Hu | 343/702 |
| 6,515,634 | B2 | 2/2003 | Desclos et al. | 343/818 |
| 6,608,594 | B1 * | 8/2003 | Kane et al. | 343/700 MS |
| 6,720,923 | B1 | 4/2004 | Hayward et al. | 343/700 |
| 6,778,134 | B2 | 8/2004 | Dooley et al. | 342/357.1 |
| 6,788,255 | B2 * | 9/2004 | Sakamoto et al. | 343/700 MS |
| 6,857,016 | B1 | 2/2005 | Motoyama et al. | 709/224 |
| 6,859,174 | B2 | 2/2005 | Kane et al. | 343/700 |
| 6,888,505 | B2 * | 5/2005 | Tran | 343/702 |
| 7,009,563 | B2 * | 3/2006 | Mori et al. | 343/700 MS |
| 7,030,830 | B2 * | 4/2006 | Azoulay et al. | 343/815 |
| 7,180,464 | B2 * | 2/2007 | Chiang et al. | 343/833 |
| 7,656,353 | B2 * | 2/2010 | Qi et al. | 343/702 |
| 8,063,836 | B2 * | 11/2011 | Qi et al. | 343/702 |
| 2003/0011514 | A1 | 1/2003 | Kirchofer et al. | 342/372 |
| 2004/0032370 | A1 | 2/2004 | Ito et al. | 343/702 |
| 2005/0174298 | A1 | 8/2005 | Chiang et al. | 343/834 |

* cited by examiner

| RANDOM IP ID | AVERAGE COMPRESSED HEADER SIZE (BYTES) | SIZE OF COMP WITH RESPECT TO FULL HEADER | REVERSE LINK BANDWIDTH REQUIRED (bps) |
|---|---|---|---|
| NO | 1.0191 | 2.5% | 22.3359 |
| YES | 3.0209 | 7.5% | 22.5230 |

FIG.3A

| WB-AMR | SPEECH FRAME (BITS) | RTP PAYLOAD (BITS) | MAC, RLC, PDCP HEADERS (BITS) | ROHC HEADER (BITS) | TOTAL TB SIZE (BITS) | NEAREST ALLOWED TB SIZE AS PER 36.213 | REQUIRED 3GPP COMPLAINT TB SIZE WITH AN EXEMPLARY EMBODIMENT OF THE INVENTION | GHANGES IN USER PER/ SUBFRAME | % SAVINGS |
|---|---|---|---|---|---|---|---|---|---|
| 6.6 kbps | 136 | 144 | 24 | 24 | 192 | 208 | 192-16=176 | 32.7 TO 36.8 | 12.5% |
| 8.85 kbps | 184 | 192 | 24 | 24 | 240 | 256 | 240-16=224 | 28.2 TO 31.2 | 10.6% |
| 12.65 kbps | 256 | 264 | 24 | 24 | 312 | 328 | 313-16=296 | 23.7 TO 25.1 | 5.9% |

FIG.3B

MOBILE WIRELESS COMMUNICATIONS DEVICE COMPRISING A SATELLITE POSITIONING SYSTEM ANTENNA WITH ACTIVE AND PASSIVE ELEMENTS AND RELATED METHODS

RELATED APPLICATION

This application is a continuation of Ser. No. 12/638,093 filed Dec. 15, 2009, now U.S. Pat. No. 8,063,836, which, in turn, is a continuation of Ser. No. 11/288,896 filed Nov. 29, 2005 now U.S. Pat. No. 7,656,353 issued Feb. 2, 2010, the entire disclosures of which are hereby incorporated herein by reference.

FIELD OF THE INVENTION

The present invention relates to the field of communications devices, and, more particularly, to mobile wireless communications devices and related methods.

BACKGROUND OF THE INVENTION

Cellular communications systems continue to grow in popularity and have become an integral part of both personal and business communications. Cellular telephones allow users to place and receive voice calls most anywhere they travel. Moreover, as cellular telephone technology has increased, so too has the functionality of cellular devices. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Another feature which is being coupled with cellular communications capabilities is satellite positioning. That is, certain devices now incorporate both cellular and satellite positioning devices, such as global positioning system (GPS) devices, for example. One such device is described in U.S. Pat. No. 6,857,016 to Motoyama et al., which is directed to a computer remote position reporting device which includes a global positioning system (GPS) receiver, monitoring software and an Internet access module for tracking and mapping a position of a mobile object. In one embodiment, the obtained positions are collected, logged and communicated to a desired location by a store-and-forward protocol (e.g., Internet e-mail) or a direct-connection protocol (e.g., file transfer protocol (FTP)) via a wireless cellular transceiver.

As the functionality of cellular communications devices continues to increase, so too does the demand for smaller devices which are easier and more convenient for users to carry. As such, incorporating GPS capabilities in ever-smaller cellular phones becomes increasingly difficult, as smaller GPS antenna designs are required due to space constraints. Thus, one challenge for designers is to provide GPS antennas with adequate signal reception characteristics yet in a relatively small size.

Various attempts have been made improve mobile device satellite positioning antennas. An antenna arrangement for a GPS signal processing device is disclosed in U.S. Pat. No. 6,720,923 to Hayward et al. in which an antenna member is mounted on a circuit board. The antenna member includes first, second, and third surfaces. The third surface adjoins the first and second surfaces. The first, second and third surfaces define a cavity within which is disposed dielectric material.

At least one conductive connector comprising first and second ends is in communication with the antenna member first surface, and an amplifier is in communication with each conductive connector second end.

Another example is set forth in PCT publication no. WO 02/29988 A1, which discloses a folded inverted F antenna (FIFA) which includes an L-shaped receiving element having a first planar portion and a second planar portion connected along a fold edge. A printed circuit board (PCB) is disposed perpendicular to the second planar portion forming a PCB ground plane. The FIFA includes a second ground plane disposed below and in parallel with the second planar portion. Shorting conductors couple the receiving element to the PCB and the second ground plane, and a receive conductor couples a receiver circuit to the receiving element. The FIFA is for use in a wireless communications device, such as a cellular phone, for receiving position signals from a GPS satellite.

Despite the availability of such GPS antenna configurations, other GPS antenna configurations may be desirable which are relatively compact yet still provide desired beam direction or shaping for optimizing OPS satellite signal reception, for example.

BRIEF DESCRIPTION OF THE DRAWINGS

FIG. 3 is a schematic perspective view of a PCB and satellite positioning antenna arrangement for the wireless communications device of FIG. 1.

DETAILED DESCRIPTION OF THE PREFERRED EMBODIMENTS

Figure 1:
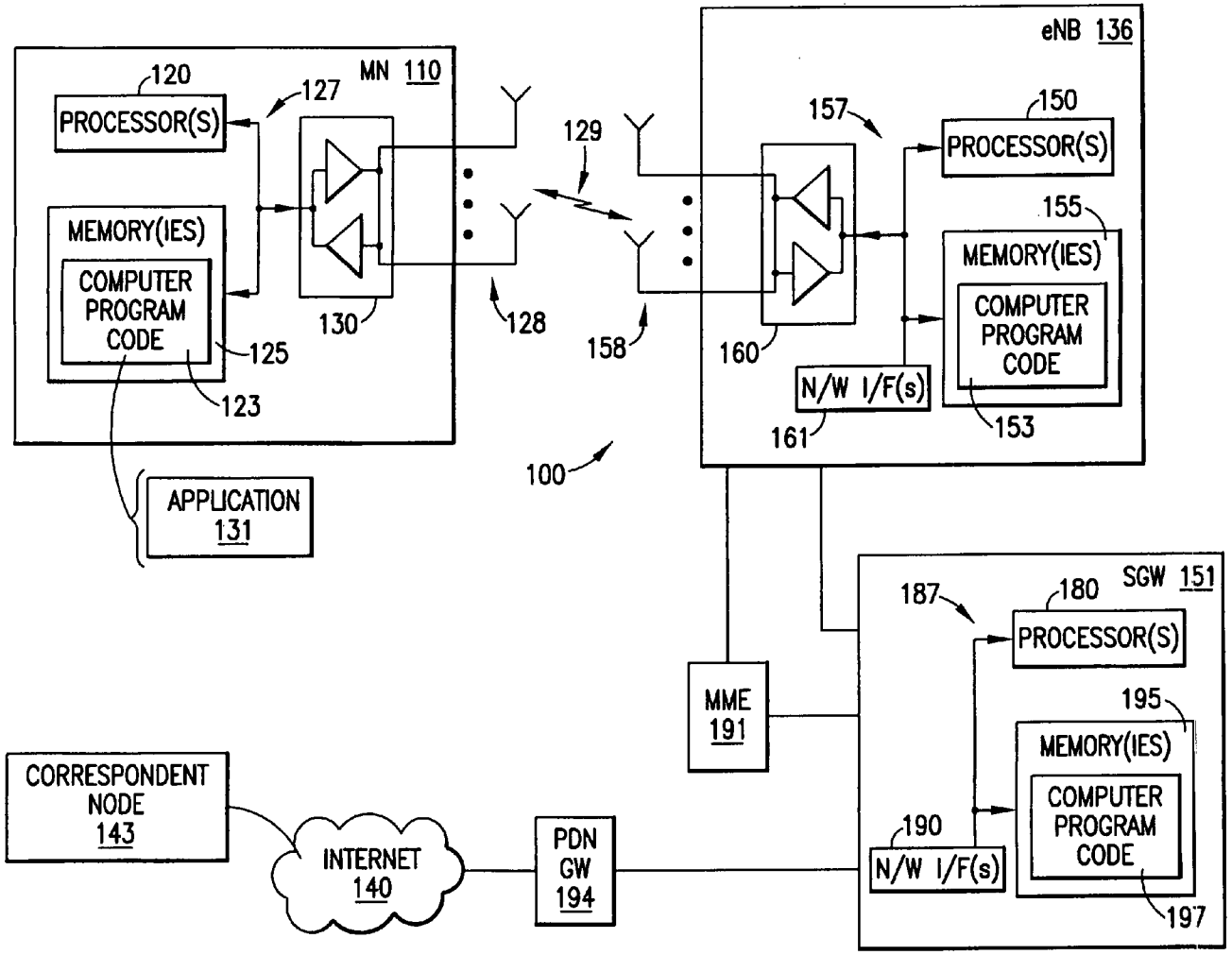
FIG. 1 is a schematic block diagram of a mobile wireless communications device.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime and multiple prime notation are used to indicate similar elements in alternate embodiments.

Generally speaking, a mobile wireless communications device is disclosed herein which may include a portable housing, at least one wireless transceiver carried by the portable housing, and a satellite positioning signal receiver carried by the portable housing. Moreover, a satellite positioning antenna may be carried by the portable housing. The satellite positioning antenna may include an active element connected to the satellite positioning signal receiver, and a passive element connected to a voltage reference and positioned in spaced apart relation from the active element and operatively (e.g., operatively or capacitively) coupled thereto for directing a beam pattern thereof.

More particularly, at least one of the active and passive elements may include a tuning feature. Additionally, the passive element may define a U-shaped portion, and a portion of the active element may be positioned within the U-shaped portion of the active element. The passive element may also include a pair of parallel branches, and a portion of the active element may be positioned between the parallel branches of the passive element. Furthermore, the active and passive elements may each include first end portions that are substantially parallel.

The mobile wireless communications device may also include a printed circuit board (PCB) carried by the portable housing, and the satellite positioning antenna and the PCB may be relatively positioned so that the PCB further directs the beam pattern of the antenna. By way of example, the active and passive elements may include electrically conductive traces on the PCB. Moreover, a dielectric extension may extend outwardly from the PCB, and the active and passive elements may be carried by the dielectric extension. The active and passive elements may be monopole antenna elements, for example.

The portable housing may have an upper portion and a lower portion, and the satellite positioning antenna may be positioned adjacent the upper portion of the portable housing. Furthermore, the at least one wireless transceiver may be a cellular transceiver, and a cellular antenna may also be carried by the portable housing and connected to the cellular transceiver. The mobile wireless communications device may additionally include a controller carried by the portable housing and connected to the satellite positioning signal receiver, and a display carried by the portable housing and cooperating with the controller for displaying satellite positioning information.

A method aspect for making a mobile wireless communications device generally includes positioning a satellite positioning signal receiver and at least one wireless transceiver in a portable housing, and connecting an active element of a satellite positioning antenna and carried by the portable housing to the satellite positioning signal receiver. The method may further include positioning a passive element of the satellite positioning antenna connected to a voltage reference in spaced apart relation from the active element and operatively coupled thereto for directing a beam pattern thereof.

Figure 2:
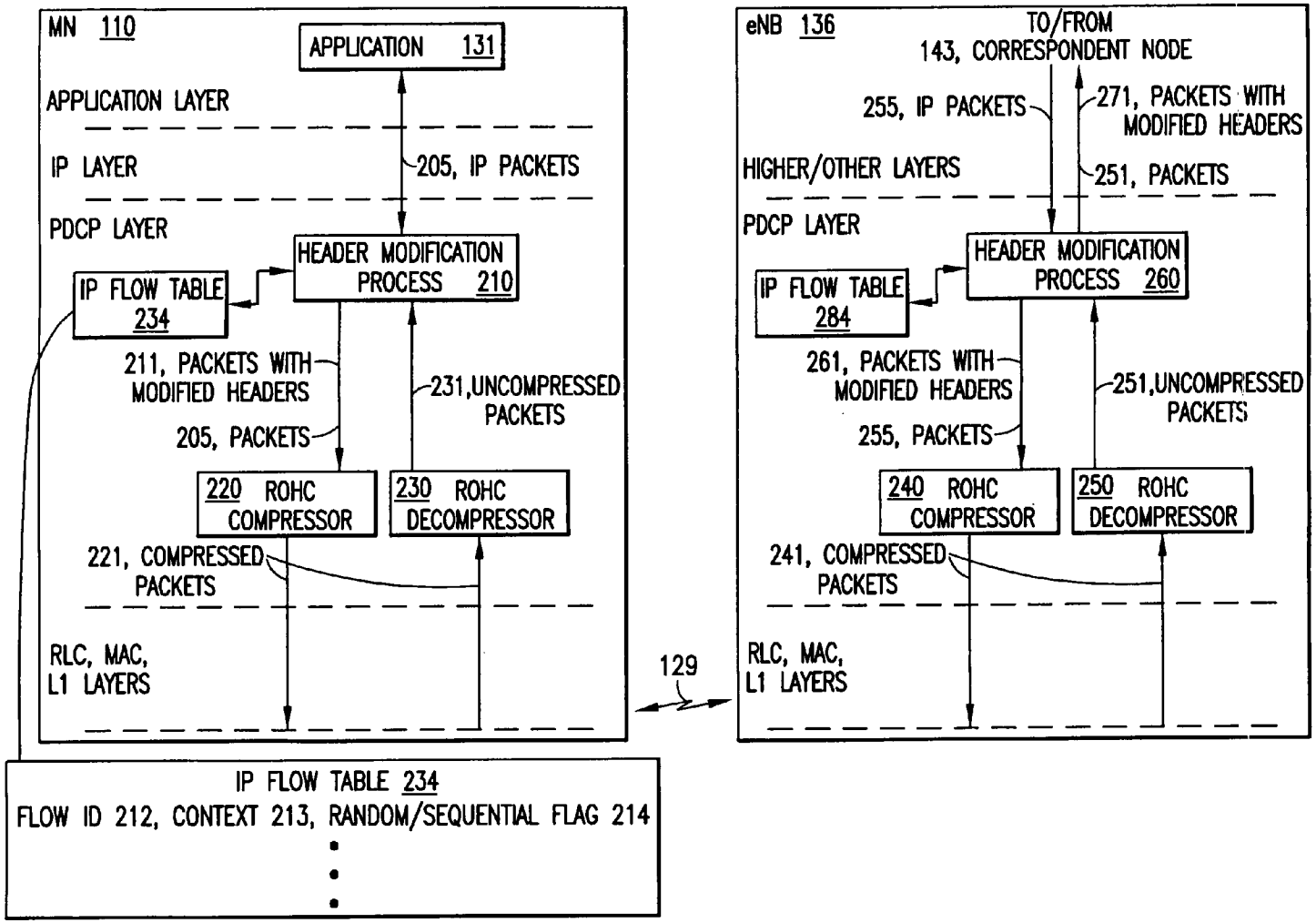
FIG. 2 is a schematic block diagram of an alternate embodiment of the mobile wireless communication device of FIG. 1.

Referring initially to FIGS. 1 and 2, a mobile wireless communications device 20 illustratively includes a portable housing 21 and one or more wireless transceivers 22 carried by the portable housing. In the example illustrated in FIG. 2, a cellular transceiver 22' cooperates with a cellular antenna 23' to communicate over a cellular network 24' via a base station(s) 25', which is shown as a cell tower for clarity of illustration. In other embodiments, the wireless transceiver 22 may be a wireless local or personal area network (LAN/PAN) transceiver for communicating via a wireless LAN/PAN, for example. In still further embodiments, both cellular and wireless LAN/PAN transceivers may be included, as will be appreciated by those skilled in the art.

The device 20 further illustratively includes a satellite positioning signal receiver 26 carried by the portable housing. By way of example, the satellite positioning signal receiver 26 may be a GPS receiver, although receivers compatible with other satellite positioning systems such as Galileo, for example, may also be used. A satellite positioning antenna 35 is also carried by the portable housing 21 and is connected to the satellite positioning signal receiver 26 for receiving positioning signals from GPS satellites 28, as will be appreciated by those skilled in the art.

More particularly, the satellite positioning antenna 35 illustratively includes an active element 27 connected to the satellite positioning signal receiver 26, and a passive element 29 connected to a voltage reference (e.g., ground) and positioned in spaced apart relation from the active element and operatively (e.g., inductively or capacitively) coupled thereto for directing a beam pattern thereof. That is, passive element 29 advantageously helps to direct or shape the beam pattern of the active element 27 skyward toward the GPS satellites 28 when the mobile wireless communications device 20 is held in an operating position, as will be discussed further below.

Turning now additionally to FIG. 3, the mobile wireless communications device 20 may further include a printed circuit board (PCB) 30 carried by the portable housing 21. Moreover, a dielectric extension 33 illustratively extends outwardly from the PCB 30, and the active and passive elements 27, 29 are carried on an upper surface of the dielectric extension. In the illustrated embodiment, the satellite positioning signal receiver 26 is schematically shown as a signal source on the PCB 30 for clarity of illustration, and the active and passive elements 27, 29 are monopole antenna elements comprising printed conductive traces on an upper surface of the dielectric extension 33. However, other types of antenna elements may be used in other embodiments.

The active and passive elements 27, 29 and the PCB 30 are relatively positioned, for example in a laterally spaced apart relation, so that the PCB further directs the beam pattern of the active element 27. More particularly, the PCB 30 will be oriented in a generally vertical direction when held in an operating position by a user. Accordingly, the upper surface of the dielectric extension 33, which is preferably positioned adjacent the upper portion (i.e., top) of the housing 21, will therefore be pointing upward or skyward toward the satellites 28, which along with the generally vertically oriented PCB 30 and the passive element 29 advantageously directs the beam pattern of the active element 27 in this direction, as will be appreciated by those skilled in the art.

Figure 4:
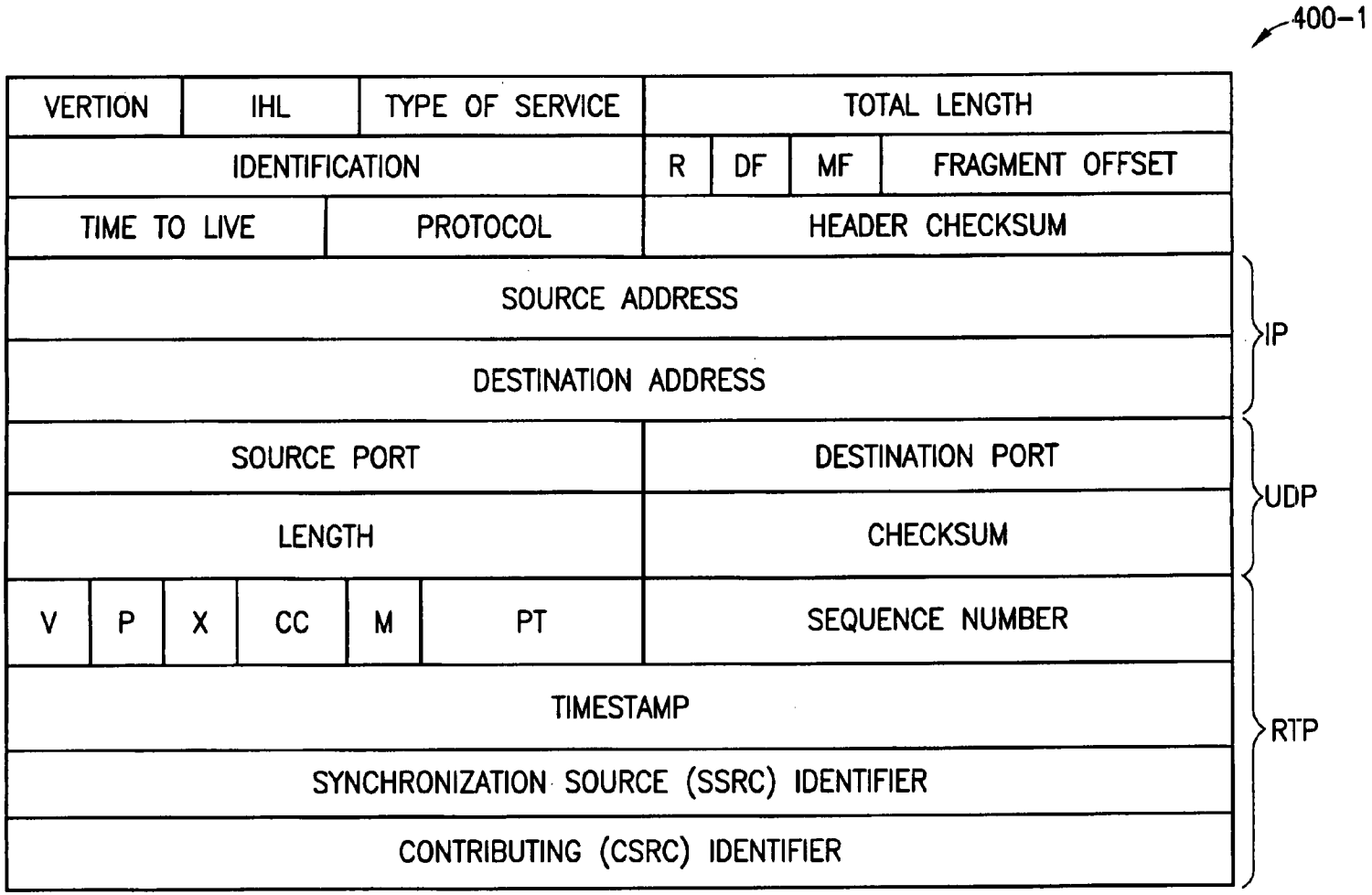
FIG. 4 is a schematic diagram of an alternate embodiment of the satellite positioning antenna of FIG. 3.

In an alternate embodiment of the satellite positioning antenna 35' illustrated in FIG. 4, the active and passive elements 27', 29' each include respective first end portions 36', 37' that are substantially parallel, similar to the active and passive elements 27, 29 illustrated in FIG. 3. However, these two embodiments differ in that the feed points for the active and passive elements 27, 29 are on opposite ends of the elements, whereas the feed points for the active and passive elements 27', 29' are located at the same end of the elements as shown. Moreover, the passive element 29' includes a tuning feature, namely a U-shaped loop-back portion 38'.

Other embodiments in which the active element 27 and/or the passive element 29 includes a tuning feature are now described with reference to FIGS. 5-8, in which similar elements are indicated with reference numerals incremented by intervals of ten (e.g., the active element 27 is labeled as 57, 67, 77, and 87 in FIGS. 5, 6, 7, and 8, respectively). Generally speaking, a tuning feature may be used to change the electrical length of a conductive element and, thus, the operational characteristics of the antenna, as will be appreciated by those skilled in the art. The various tuning features used in a given embodiment will depend upon the particular configuration of the device and antenna, particularly the amount of space and/or surface area available for implementing the antenna, as will be appreciated by those skilled in the art.

Figure 5:
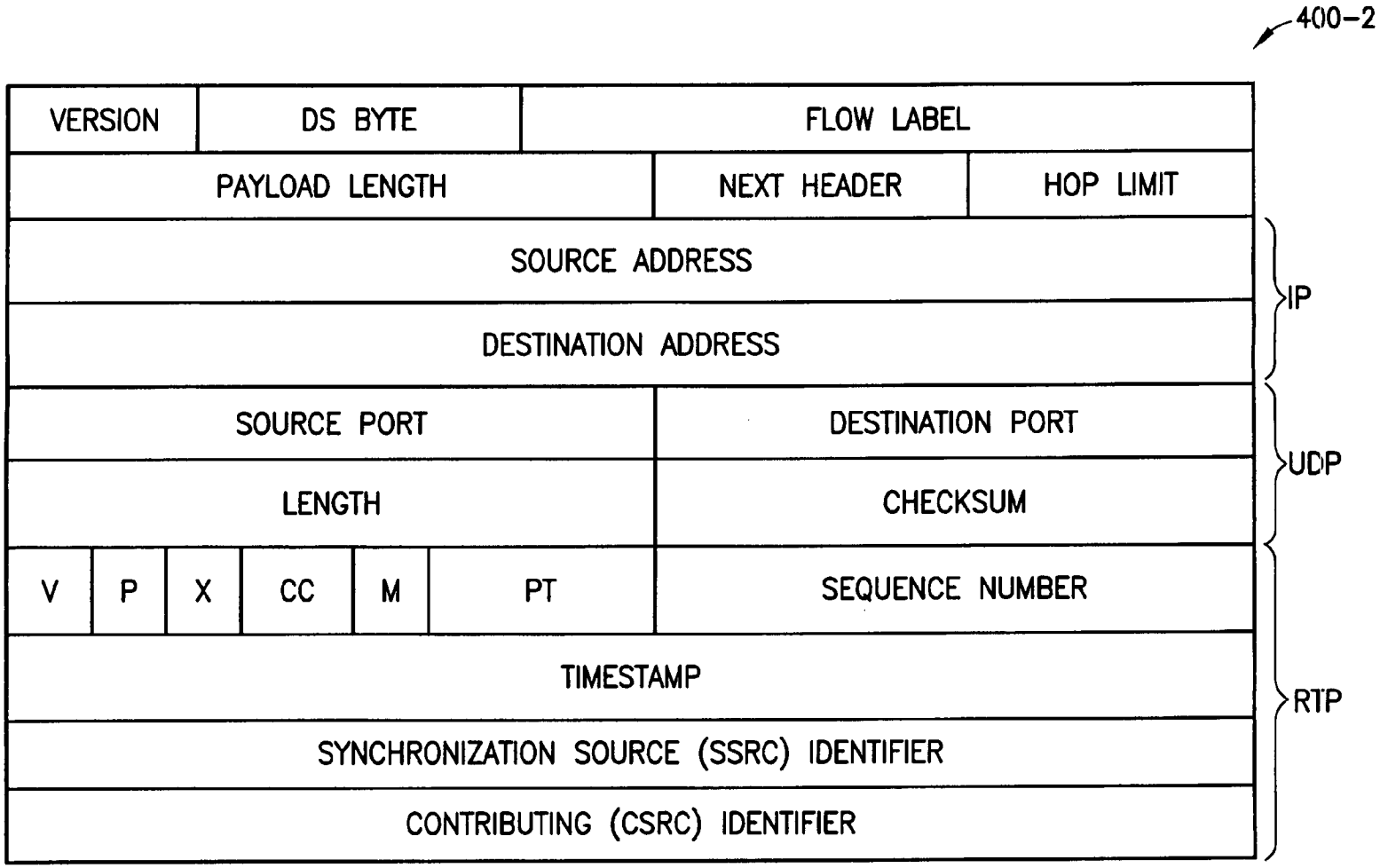
FIGS. 5-8 are schematic diagrams of alternate embodiments of satellite positioning antennas for a mobile wireless communications device.
Figure 6:
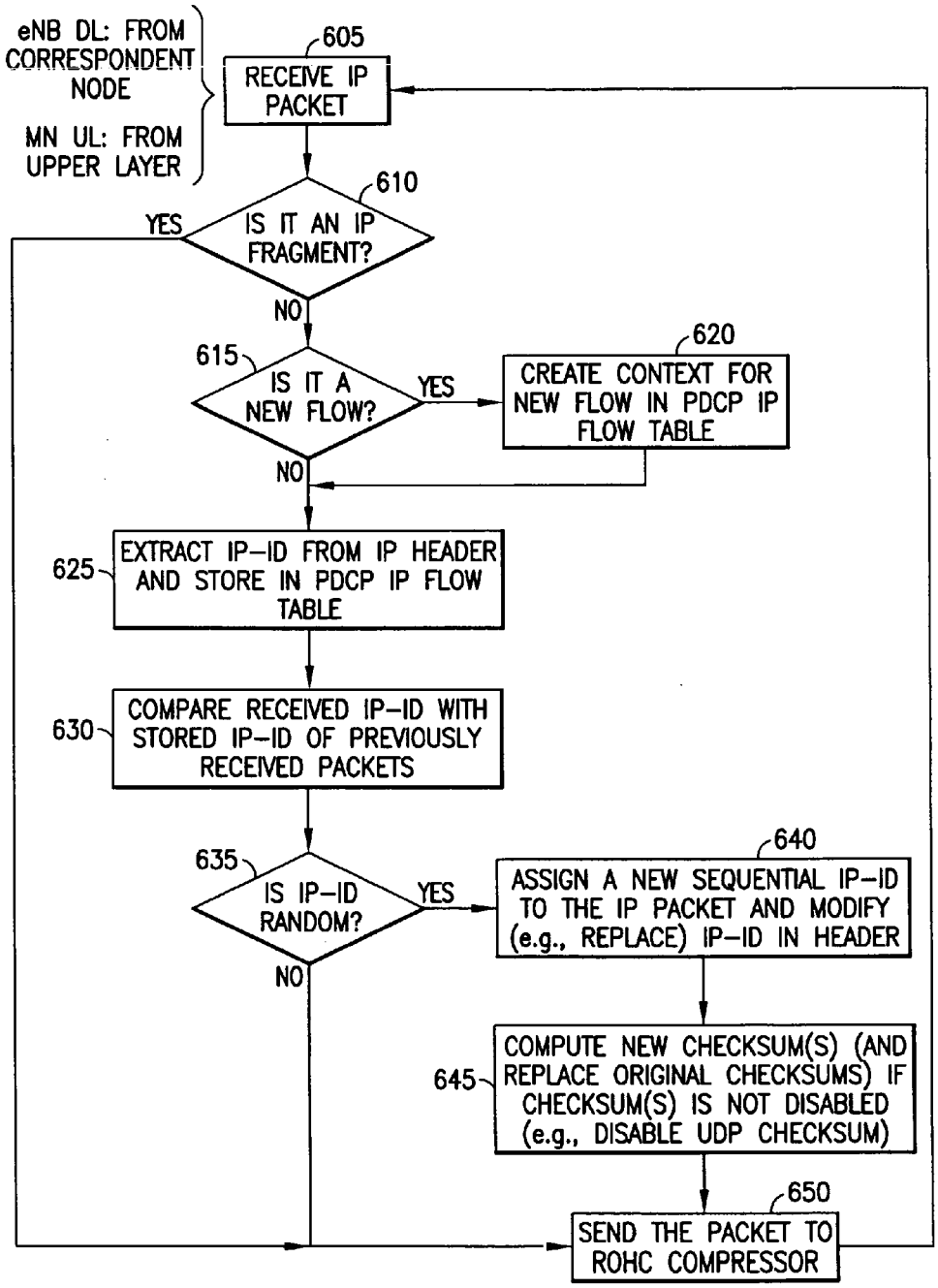
Figure 7:
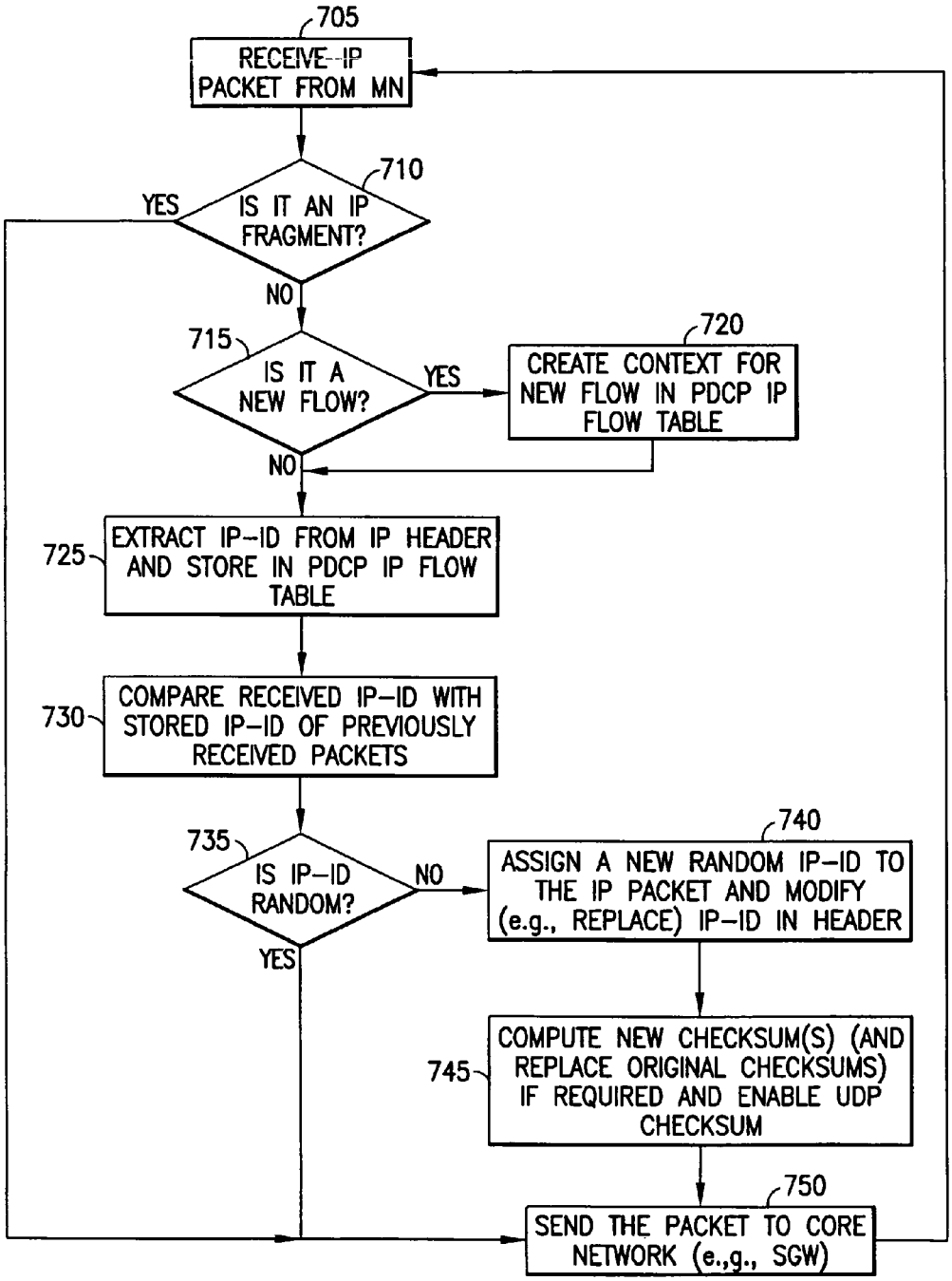
Figure 8:
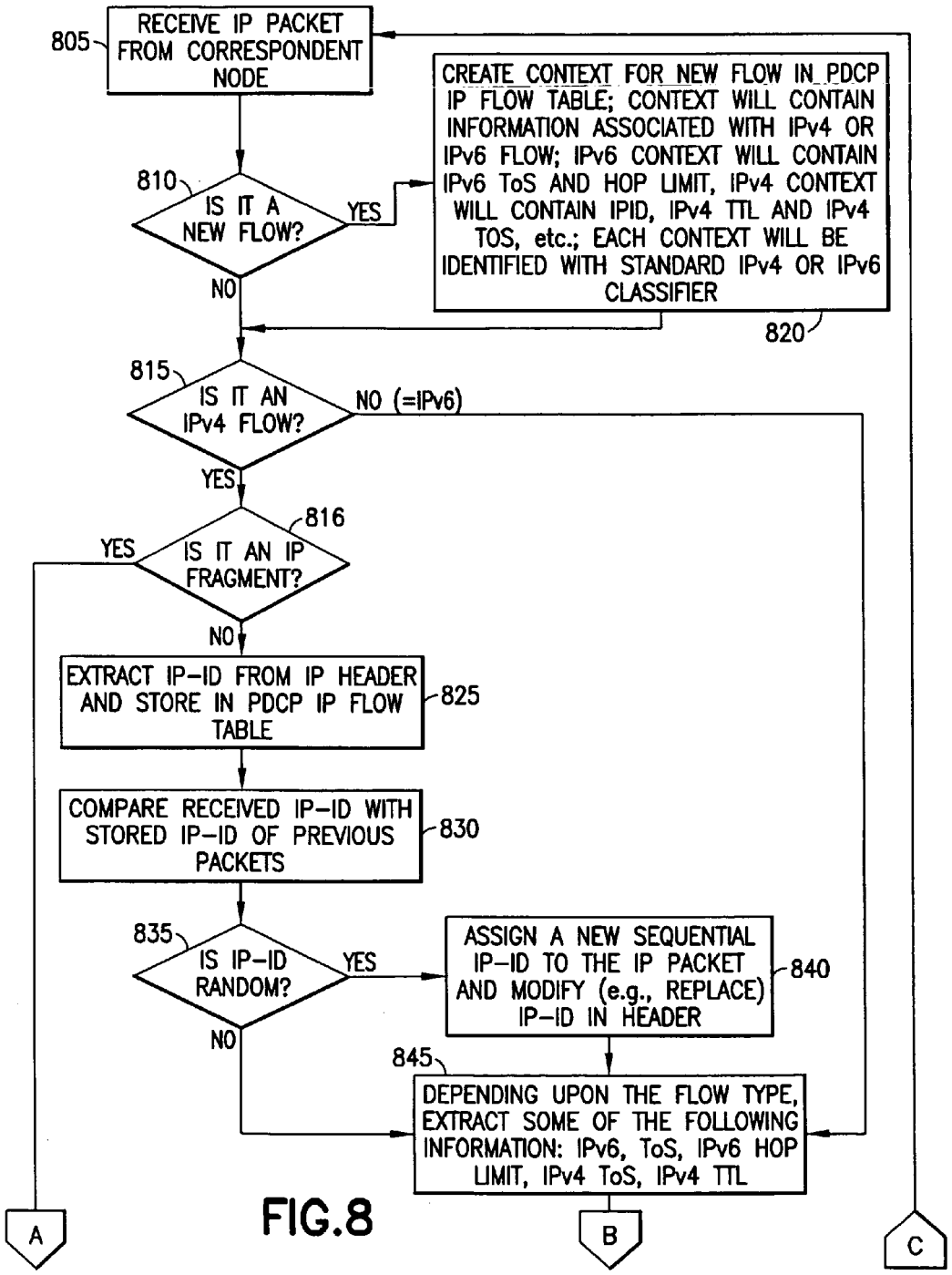
Figure 8:
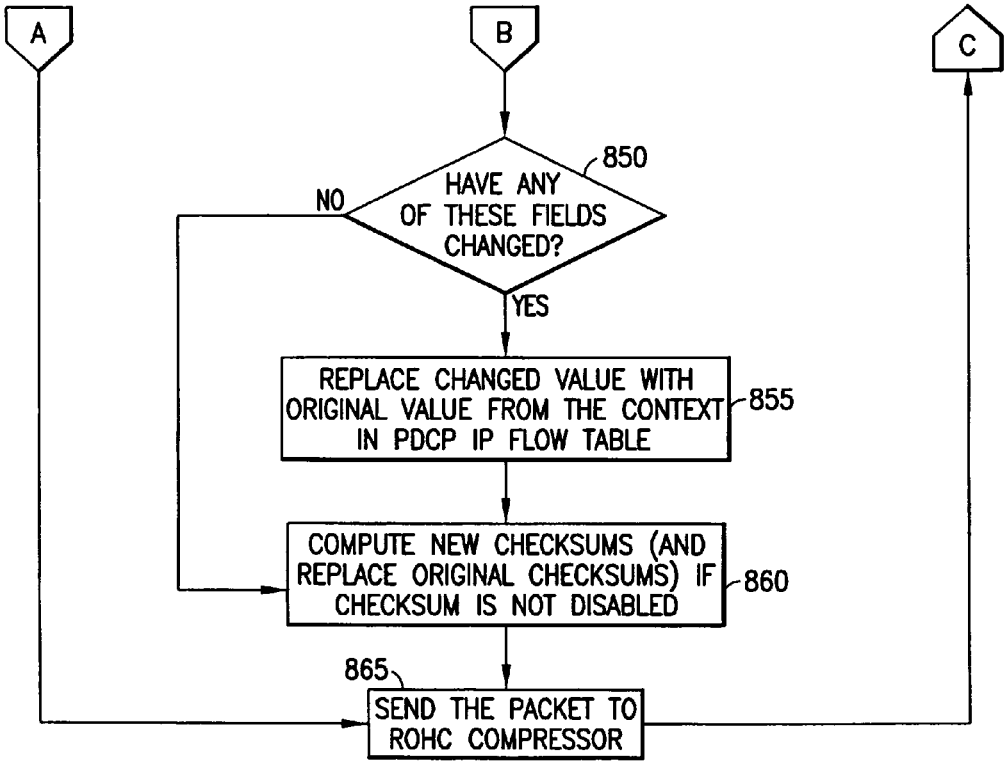

In the exemplary embodiments illustrated in FIGS. 5 and 6, the active and passive elements 57, 59 each has a generally sinusoidal tuning feature. The passive element 79 defines a U-shaped portion, and a portion of the active element 77 is positioned within the U-shaped portion of the passive element. The passive element 89 includes a pair of parallel branches, and a portion of the active element 87 is positioned between the parallel branches of the passive element as shown. Of course, it will be appreciated by those skilled in the art that numerous other tuning features and configurations may be used in different embodiments.

Figure 9:
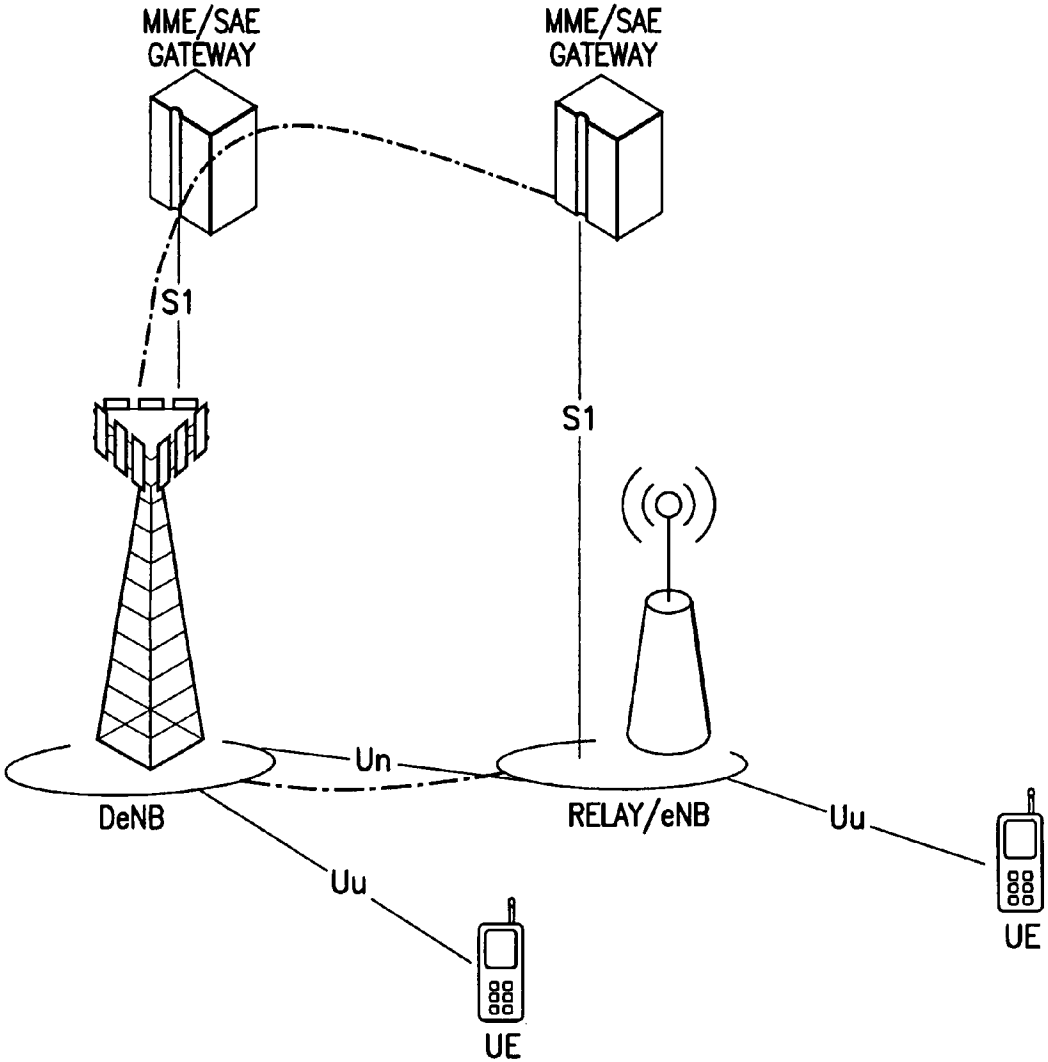
FIG. 9 is a schematic block diagram of the wireless communications device of FIG. 1 illustrating satellite positioning information display features thereof.

Turning now additionally to FIG. 9, the device 20 further illustratively includes a controller 31 carried by the portable housing 21 and connected to the satellite positioning signal receiver 26, and a display 32 carried by the portable housing and cooperating with the controller for displaying satellite positioning information. By way of example, the controller 31 may include a microprocessor and associated circuitry/memory, and the display 32 may be a liquid crystal display (LCD), although other suitable components or displays may also be used. While not shown in FIG. 9, the controller 31 may be carried by the PCB 30, as will be appreciated by those skilled in the art. It should be noted that those components which are within the portable housing and not externally viewable are shown with dashed lines for clarity of illustration in FIG. 9. Moreover, while the satellite positioning antenna is illustratively at the bottom of the device 20 in FIG. 9 also for clarity of illustration, this antenna may be positioned adjacent the top of the device (i.e., behind the display in the illustrated embodiment), as noted above.

When using the GPS function of the device 20 a user may hold the device in an upright position in which the display 32 is viewable to the user. In the exemplary embodiment, the controller 31 executes a mapping program which translates the positioning data received from the satellite positioning signal receiver 26 into location coordinates which are displayed at a corresponding location on a map, as will be readily appreciated by those skilled in the art. Thus, when the user holds the device 20 so that the display 32 faces him in the upright position, the PCB 30 serves as a reflector for directing the antenna beam pattern skyward for improved satellite positioning signal reception performance, as noted above.

The passive element 29 not only helps direct/shape the beam pattern in the desired direction, it may also provide desired antenna efficiency, as will be appreciated by those skilled in the art. By way of example, the performance of the 35' illustrated in FIG. 4 was tested at various frequencies and provided the results listed in Table 1 below.

TABLE 1

| | 1565.42 MHZ | 1575.42 MHZ | 1585.42 MHZ |
|---|---|---|---|
| Average Gain | −3.34526 dB | −2.95445 dB | −2.65694 dB |

As noted above, the dielectric extension 33 and antenna 35 are advantageously positioned adjacent an upper portion or top of the portable housing 21 to advantageously direct or shape the beam pattern skyward when a user holds the device 20 so that he can see the display 32, as will be appreciated by those skilled in the art. Moreover, this allows the cellular (or other wireless) antenna 23 to be carried adjacent the bottom portion of the portable housing 21, as schematically illustrated in FIG. 2. This not only provides for reduced interference between the two antennas, but it may also help with specific absorption ratio (SAR) compliance by moving the cellular antenna 23 further away from a user's brain when he places the input audio transducer of the device 20 (not shown) adjacent his ear, as will also be appreciated by those skilled in the art.

A method aspect of the invention is for making the mobile wireless communications device 20 and may include positioning a satellite positioning signal receiver 26 and at least one wireless transceiver 22 in a portable housing 21, and connecting an active element 27 of a satellite positioning antenna 35 and carried by the portable housing to the satellite positioning signal receiver. The method may further include positioning a passive element 29 of the satellite positioning antenna 35 connected to a voltage reference (e.g., ground) in spaced apart relation from the active element 27 and operatively coupled thereto for directing a beam pattern thereof, as discussed further above.

Advantages of the above-described satellite positioning antenna structure may include allowing for downsizing of an overall antenna design where implementation area is relatively small. Moreover, the antenna structure provides for an effective use of the device's PCB board to improve efficiency. In addition, the antenna structure accommodates numerous geometries to thereby provide flexibility of implementation.

Figure 10:
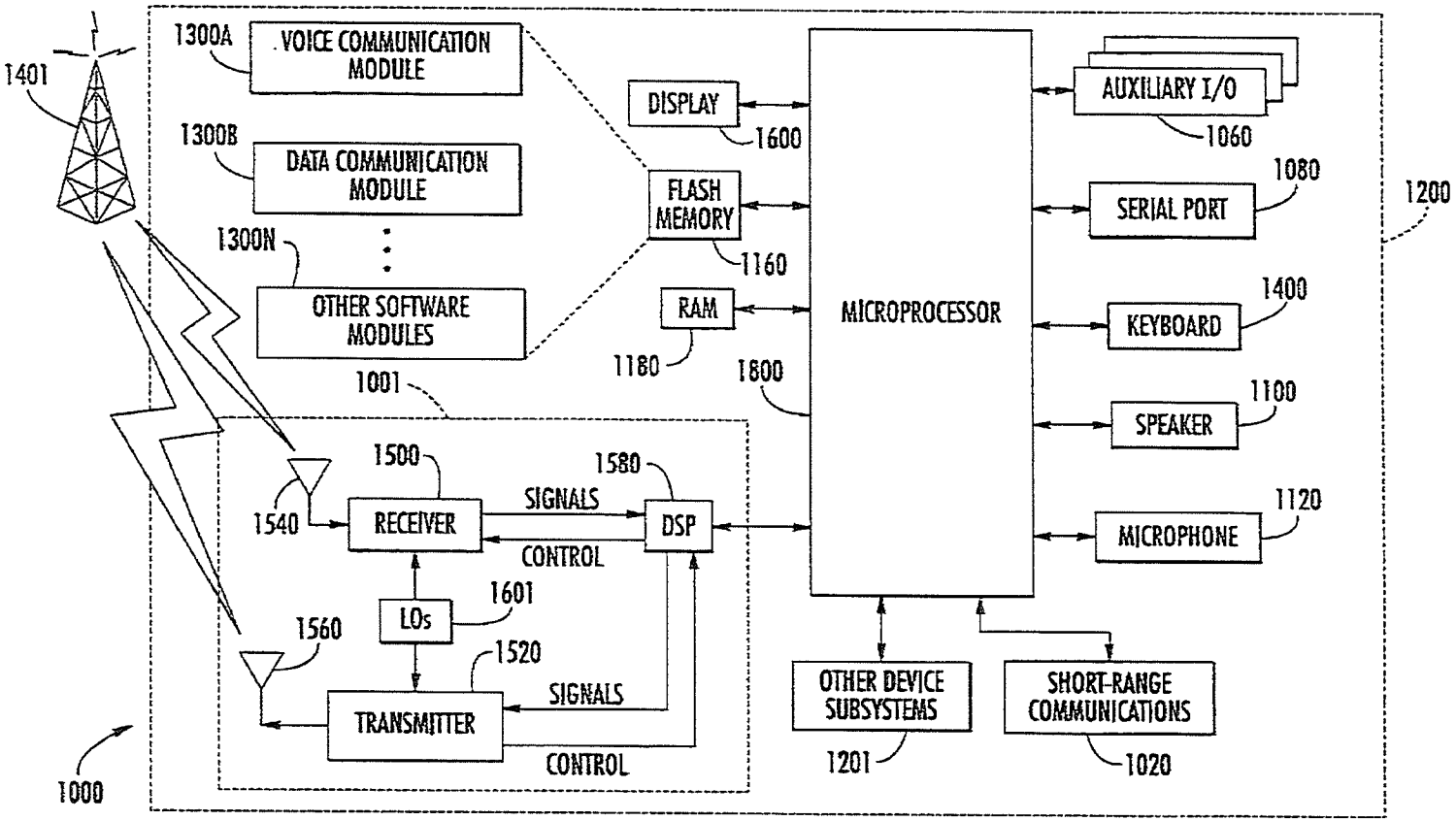
FIG. 10 is a schematic block diagram of an exemplary mobile wireless communications device arrangement for use with the present invention.

Additional features and components of a mobile wireless communication device in accordance with the present invention will be further understood with reference to FIG. 10. The device 1000 includes a housing 1200, a keyboard 1400 and an output device 1600. The output device shown is a display 1600, which is preferably a full graphic LCD. Other types of output devices may alternatively be utilized. A processing device 1800 is contained within the housing 1200 and is coupled between the keyboard 1400 and the display 1600. The processing device 1800 controls the operation of the display 1600, as well as the overall operation of the mobile device 1000, in response to actuation of keys on the keyboard 1400 by the user.

The housing 1200 may be elongated vertically, or may take on other sizes and shapes (including clamshell housing structures). The keyboard may include a mode selection key, or other hardware or software for switching between text entry and telephony entry.

In addition to the processing device 1800, other parts of the mobile device 1000 are shown schematically in FIG. 10. These include a communications subsystem 1001; a short-range communications subsystem 1020; the keyboard 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, PCS, GSM, etc. Other types of data and voice networks, both separate and integrated, may also be utilized with the mobile device 1000.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keyboard 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth communications module to provide for communication with similarly-enabled systems and devices.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A mobile wireless communications device comprising:

a portable housing;

a printed circuit board (PCB) carried by said portable housing;

a wireless communications antenna carried by said portable housing;

a wireless communications transceiver carried by said portable housing and coupled to said wireless communications antenna;

a satellite positioning signal receiver carried by said portable housing; and a planar satellite positioning antenna carried by said portable housing and comprising at least one electrically conductive trace lying in a plane on said PCB defining an active element connected to said satellite positioning signal receiver, and at least one other electrically conductive trace lying in the plane on said PCB defining a passive element connected to a voltage reference and positioned in laterally spaced apart relation in the plane along said PCB from said active element and operatively coupled thereto for directing a beam pattern thereof, at least one of said active and passive elements comprising a monopole antenna element, said passive element comprising a pair of parallel branches and a base segment coupling the pair of parallel branches to define a U-shaped passive element, a portion of said active element being positioned between the parallel branches of said passive element.

2. The mobile wireless communications device of claim 1 wherein each of said active and passive elements comprises a monopole antenna element.

3. The mobile wireless communications device of claim 1 further comprising a controller and a display carried by said portable housing; and wherein said controller cooperates with said display and said satellite positioning signal receiver to display at least one geographic mapping application on said display.

4. The mobile wireless communications device of claim 1 wherein at least one of said active and passive elements comprises a tuning feature.

5. The mobile wireless communications device of claim 1 wherein said active and passive elements each comprises first end portions; and wherein the first end portions of said active and passive elements are substantially parallel.

6. The mobile wireless communications device of claim 1 wherein said planar satellite positioning antenna and said PCB are relatively positioned so that said PCB further directs the beam pattern of said planar satellite positioning antenna.

7. The mobile wireless communications device of claim 1 further comprising a dielectric extension extending outwardly from said PCB; and wherein said active and passive elements are carried by said dielectric extension.

8. The mobile wireless communications device of claim 1 wherein said portable housing has an upper portion and a lower portion; and wherein said planar satellite positioning antenna is positioned adjacent the upper portion of said portable housing.

9. A mobile wireless communications device comprising:

a portable housing having an upper portion and a bottom portion;

a printed circuit board (PCB) carried by said portable housing;

a wireless communications antenna carried by the lower portion of said portable housing;

a wireless communications transceiver carried by said portable housing and coupled to said wireless communications antenna;

a satellite positioning signal receiver carried by said portable housing; and a planar satellite positioning antenna carried by the upper portion of said portable housing and comprising at least one electrically conductive trace lying in a plane on said PCB defining a monopole active element connected to said satellite positioning signal receiver, and at least one other electrically conductive trace lying in the plane on said PCB defining a monopole passive element connected to a voltage reference and positioned in laterally spaced apart relation in the plane along said PCB from said monopole active element and operatively coupled thereto for directing a beam pattern thereof, said monopole passive element comprising a pair of parallel branches and a base segment coupling the pair of parallel branches to define a U-shaped monopole passive element, a portion of said monopole active element being positioned between the parallel branches of said monopole passive element.

10. The mobile wireless communications device of claim 9 further comprising a controller and a display carried by said portable housing; and wherein said controller cooperates with said display and said satellite positioning signal receiver to display at least one geographic mapping application on said display.

11. The mobile wireless communications device of claim 9 wherein at least one of said monopole active and passive elements comprises a tuning feature.

12. The mobile wireless communications device of claim 9 wherein said planar satellite positioning antenna and said PCB are relatively positioned so that said PCB further directs the beam pattern of said satellite positioning antenna.

13. The mobile wireless communications device of claim 9 further comprising a dielectric extension extending outwardly from said PCB; and wherein said monopole active and passive elements are carried by said dielectric extension.

14. A method for making a mobile wireless communications device comprising:

assembling a wireless communications antenna and associated wireless communications transceiver to be within a portable housing;

assembling a printed circuit board (PCB) in the portable housing; and assembling a planar satellite positioning antenna and associated satellite positioning signal receiver to be within the portable housing, and wherein the satellite positioning antenna comprises at least one electrically conductive trace lying in a plane on the PCB defining an active element connected to the satellite positioning signal receiver, and at least one other electrically conductive trace lying in the plane on the PCB defining a passive element connected to a voltage reference and positioned in laterally spaced apart relation in the plane along the PCB from the active element and operatively coupled thereto for directing a beam pattern thereof, at least one of the active element and passive element comprising a monopole antenna element, the passive element comprising a pair of parallel branches and a base segment coupling the pair of parallel branches to define a U-shaped passive element, a portion of the active element being positioned between the parallel branches of the passive element.

15. The method of claim 14 wherein each of the active and passive elements comprises a monopole antenna element.

16. The method of claim 14 wherein at least one of the active and passive elements comprises a tuning feature.

17. The method of claim 14 wherein the active and passive elements each comprises first end portions; and wherein the first end portions of the active and passive elements are substantially parallel.

18. The method of claim 14 wherein assembling the PCB comprises assembling the PCB with a dielectric extension extending outwardly therefrom in the portable housing; and wherein the active and passive elements are carried by the dielectric extension.

* * * * *